US012024806B2

(12) United States Patent
Shibata et al.

(10) Patent No.: US 12,024,806 B2
(45) Date of Patent: Jul. 2, 2024

(54) EMBROIDERY DATA GENERATION SYSTEM, STORAGE MEDIUM STORING TERMINAL PROGRAM, AND STORAGE MEDIUM STORING APPARATUS PROGRAM

(71) Applicant: BROTHER KOGYO KABUSHIKI KAISHA, Nagoya (JP)

(72) Inventors: Kazuki Shibata, Nagoya (JP); Sayaka Kurihara, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 91 days.

(21) Appl. No.: 17/812,036

(22) Filed: Jul. 12, 2022

(65) Prior Publication Data

US 2023/0018427 A1 Jan. 19, 2023

(30) Foreign Application Priority Data

Jul. 16, 2021 (JP) ..... 2021-117784

(51) Int. Cl.
*D05B 19/02* (2006.01)
*D05C 7/00* (2006.01)

(52) U.S. Cl.
CPC ..... *D05B 19/02* (2013.01); *D05C 7/00* (2013.01); *D05D 2205/18* (2013.01); *D05D 2205/32* (2013.01)

(58) Field of Classification Search
CPC ..... D05B 19/02; D05B 19/08; D05B 19/10; D05C 5/00; D05C 5/02
See application file for complete search history.

(56) References Cited

U.S. PATENT DOCUMENTS 6,196,146 B1 * 3/2001 Goldberg ..... D05B 19/10 705/26.1
7,685,072 B2 * 3/2010 Hirata ..... H04L 9/0891 700/137
9,702,071 B2 * 7/2017 Harvill ..... D05C 5/04
2005/0055553 A1 * 3/2005 Thomaidis ..... G06F 21/445 713/176

(Continued)

FOREIGN PATENT DOCUMENTS

JP 2010-136822 A 6/2010
JP 2014-012065 A 1/2014

*Primary Examiner* — Nathan E Durham
(74) *Attorney, Agent, or Firm* — Oliff PLC

(57) ABSTRACT

An embroidery data generation system includes a terminal apparatus and an embroidery data generation apparatus. A terminal controller acquires a generation condition of embroidery data inputted via an input device, transmits the acquired generation condition to the embroidery data generation apparatus via a terminal communication interface, and controls a display to display a preview image indicating an embroidery finish of an embroidery pattern based on image data transmitted from the embroidery data generation apparatus. An apparatus controller receives the generation condition transmitted from the terminal apparatus via an apparatus communication interface, generates the embroidery data for sewing the embroidery pattern based on the received generation condition, generates the image data for displaying the preview image on the display based on the received generation condition, and transmits the generated image data to the terminal apparatus having transmitted the generation condition.

14 Claims, 8 Drawing Sheets

(56) References Cited

U.S. PATENT DOCUMENTS

Figure 1:
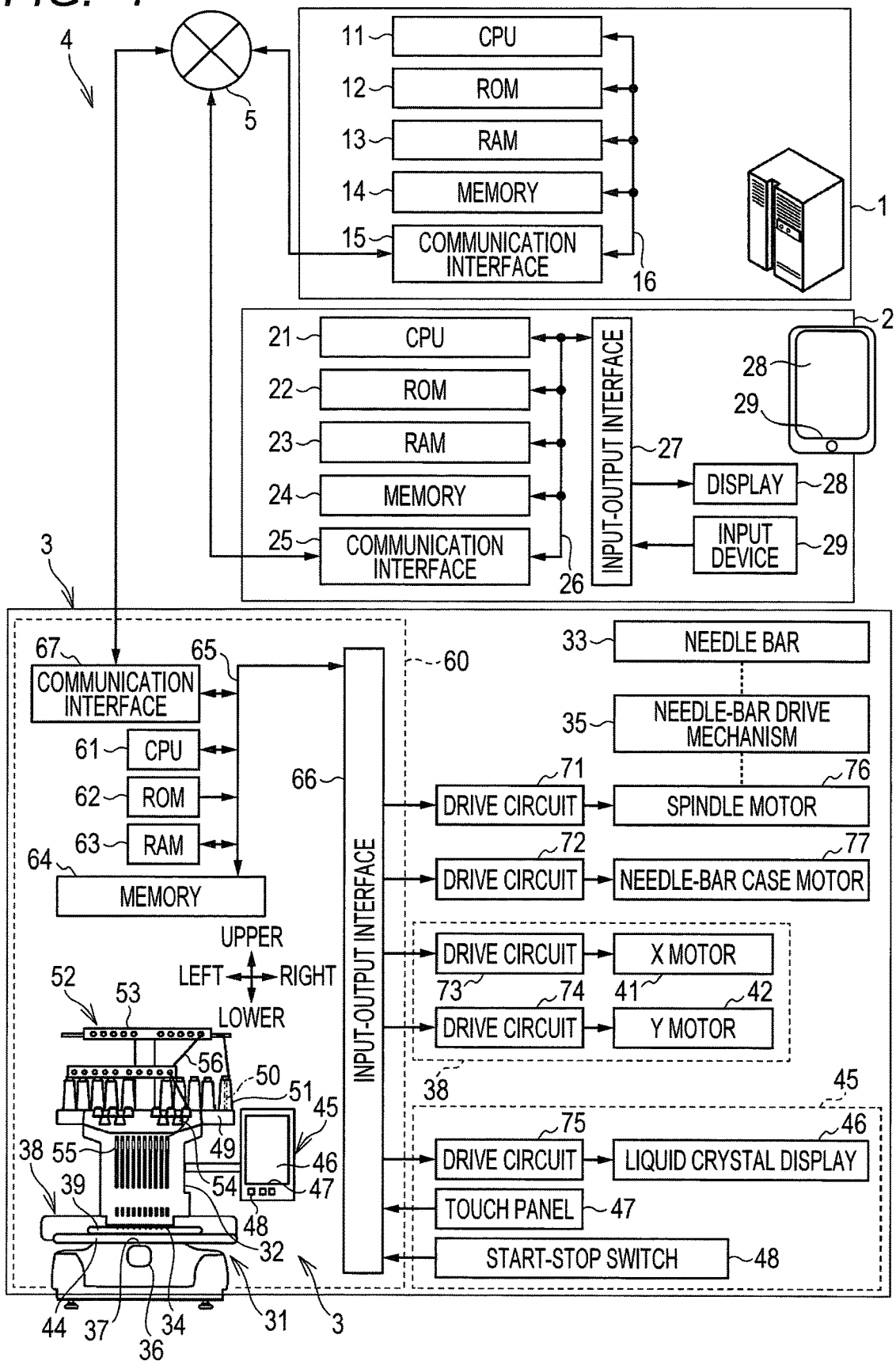

| | | | | |
|---|---|---|---|---|
| 2005/0131571 | A1* | 6/2005 | Costin | G06Q 30/0601 705/26.1 |
| 2010/0139538 | A1 | 6/2010 | Tashiro | |
| 2012/0165970 | A1* | 6/2012 | Tashiro | D05C 5/04 112/102.5 |

* cited by examiner

EMBROIDERY DATA GENERATION SYSTEM, STORAGE MEDIUM STORING TERMINAL PROGRAM, AND STORAGE MEDIUM STORING APPARATUS PROGRAM

REFERENCE TO RELATED APPLICATIONS

This application claims priority from Japanese Patent Application No. 2021-117784 filed on Jul. 16, 2021. The entire content of the priority application is incorporated herein by reference.

BACKGROUND ART

There is known an embroidery data processing apparatus configured to set a character having a character shape desired by a user as an embroidery pattern.

DESCRIPTION

An embroidery data processing apparatus includes a reading unit, a display unit, and a selection unit. The reading unit reads a plurality of embroidery data corresponding to inputted character code and character code standard. The display unit displays, on a display screen, a first embroidery shape image and a second embroidery shape image which is an embroidery shape different from the first embroidery shape image. The user sets, as an embroidery pattern, a desired embroidery shape among a plurality of embroidery shapes having different embroidery shapes displayed on the display screen.

The embroidery data processing apparatus requires a dedicated application for generating image data for displaying a preview image and generating embroidery data.

In view of the foregoing, an example of an object of this disclosure is to provide an embroidery data generation system, a storage medium storing a terminal program, and a storage medium storing an apparatus program configured to improve convenience for users when generating embroidery data for sewing an embroidery pattern with an embroidery machine.

According to one aspect, this specification discloses an embroidery data generation system. The embroidery data generation system includes a terminal apparatus and an embroidery data generation apparatus. The embroidery data generation apparatus is configured to generate embroidery data for sewing an embroidery pattern with an embroidery machine. The terminal apparatus and the embroidery data generation apparatus are connected to each other via a network so as to communicate with each other. The terminal apparatus including a terminal communication interface configured to communicate with the embroidery data generation apparatus, an input device configured to input information, a display configured to display an image, and a terminal controller configured to control the terminal communication interface and the display. The terminal controller is configured to: acquire a generation condition of the embroidery data inputted via the input device; transmit the acquired generation condition to the embroidery data generation apparatus via the terminal communication interface; and control the display to display a preview image indicating an embroidery finish of the embroidery pattern based on image data transmitted from the embroidery data generation apparatus. The embroidery data generation apparatus includes an apparatus communication interface configured to communicate with the terminal apparatus, and an apparatus controller configured to control the apparatus communication interface. The apparatus controller is configured to: receive the generation condition transmitted from the terminal apparatus via the apparatus communication interface; generate the embroidery data for sewing the embroidery pattern based on the received generation condition; generate the image data for displaying the preview image on the display of the terminal apparatus based on the received generation condition; and transmit the generated image data to the terminal apparatus having transmitted the generation condition.

According to another aspect, this specification also discloses a non-transitory computer-readable storage medium storing a set of program instructions for a terminal apparatus including an input device, a terminal communication interface, and a display. The set of program instructions, when executed by a controller of the terminal apparatus, causes the terminal apparatus to perform: acquiring a generation condition of embroidery data for sewing an embroidery pattern with an embroidery machine, the generation condition being inputted via the input device; transmitting the acquired generation condition to an embroidery data generation apparatus via the terminal communication interface; and controlling the display to display a preview image indicating an embroidery finish of the embroidery pattern based on image data transmitted from the embroidery data generation apparatus.

According to still another aspect, this specification also discloses a non-transitory computer-readable storage medium storing a set of program instructions for an embroidery data generation apparatus including an apparatus communication interface. The set of program instructions, when executed by a controller of the embroidery data generation apparatus, causes the embroidery data generation apparatus to perform: receiving a generation condition of embroidery data for sewing an embroidery pattern with an embroidery machine, the generation condition being received from a terminal apparatus via the apparatus communication interface; based on the received generation condition, generating image data for displaying a preview image indicating an embroidery finish of the embroidery pattern on a display of the terminal apparatus; transmitting the generated image data to the terminal apparatus having transmitted the generation condition; and generating the embroidery data for sewing the embroidery pattern based on the received generation condition.

FIG. 1 is a block diagram showing a schematic configuration of an embroidery data generation system 4 including an embroidery data generation apparatus 1, a terminal apparatus 2, and an embroidery machine 3.

Figure 2:
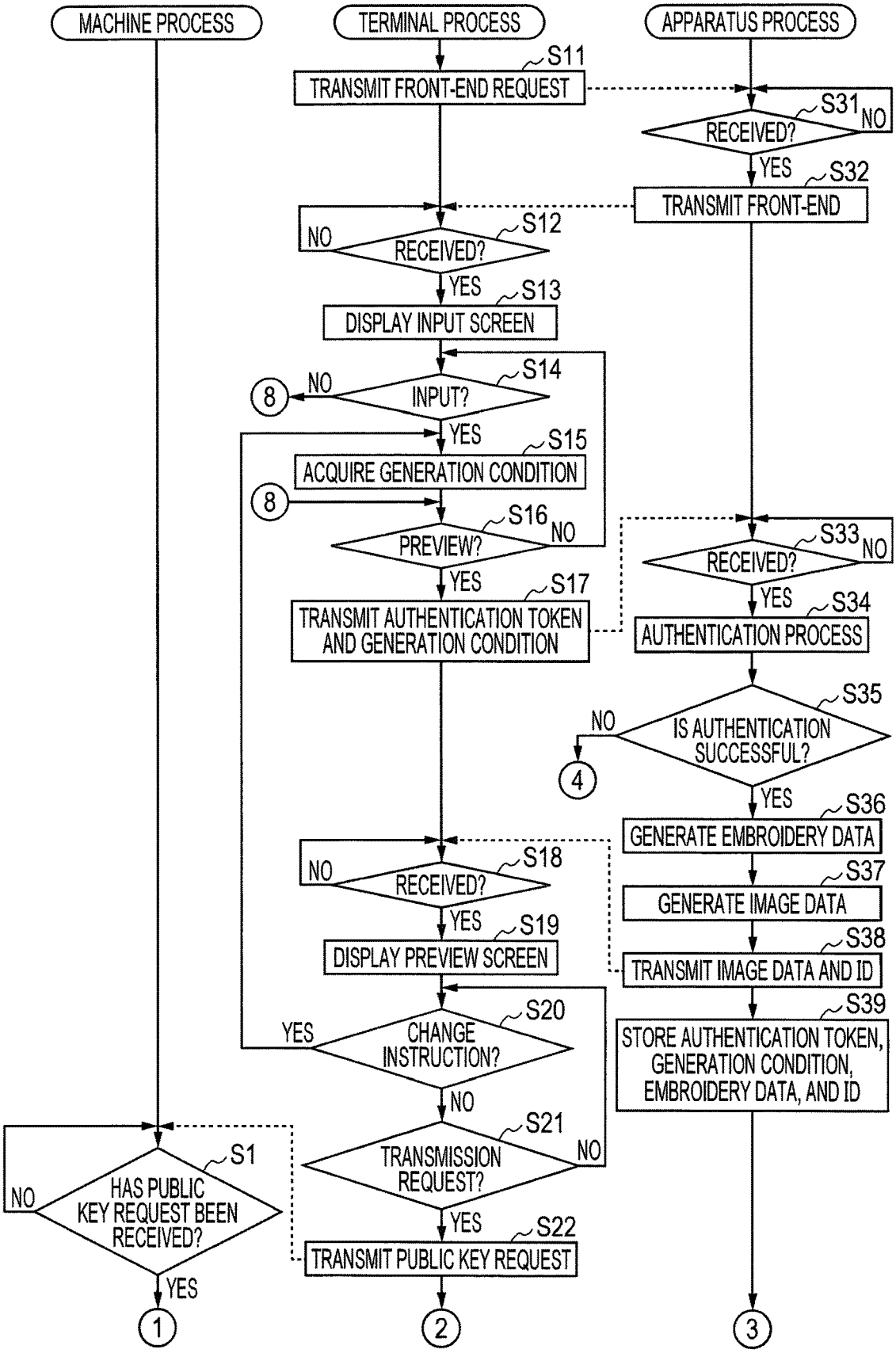

FIG. 2 is a part of a flowchart of a machine process, a terminal process, and an apparatus process executed by the embroidery data generation system 4.

Figure 3:
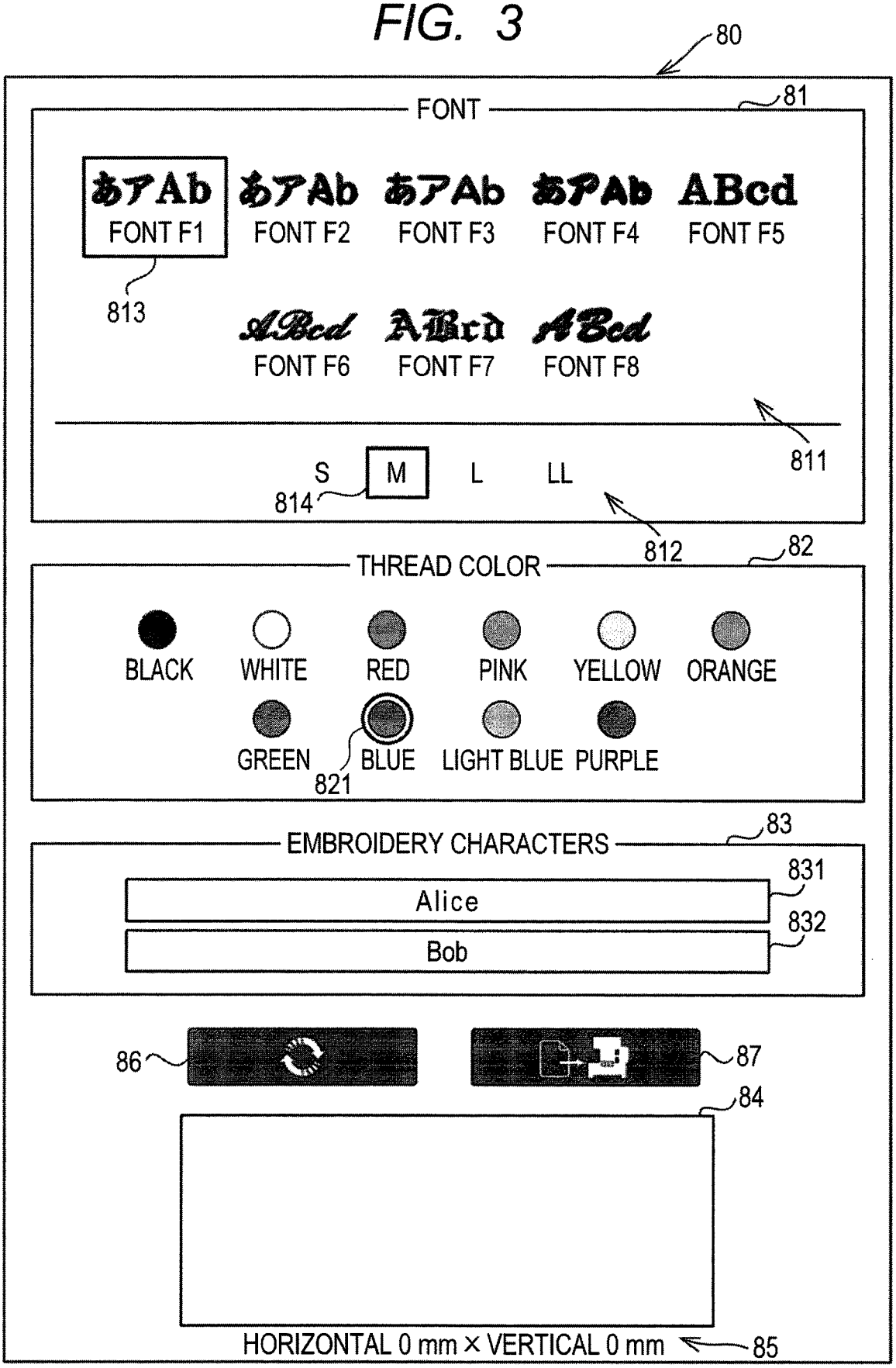

FIG. 3 is an explanatory diagram of an input screen 80 displayed on a display 28 of the terminal apparatus 2.

Figure 4:
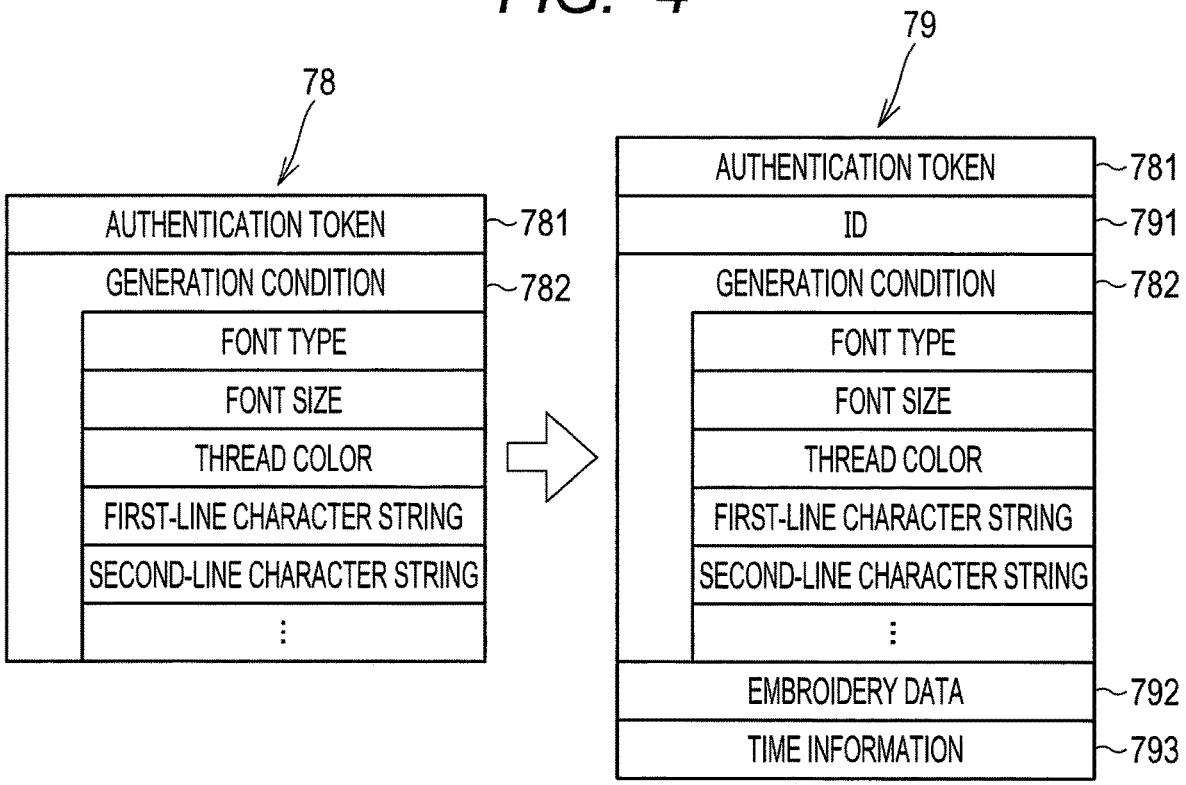

FIG. 4 is an explanatory diagram of data 78 transmitted from the terminal apparatus 2 to the generation apparatus 1 in the terminal process and data 79 stored in a memory 14 of the generation apparatus 1 based on the data 78 transmitted from the terminal apparatus 2 in the terminal process.

Figure 5:
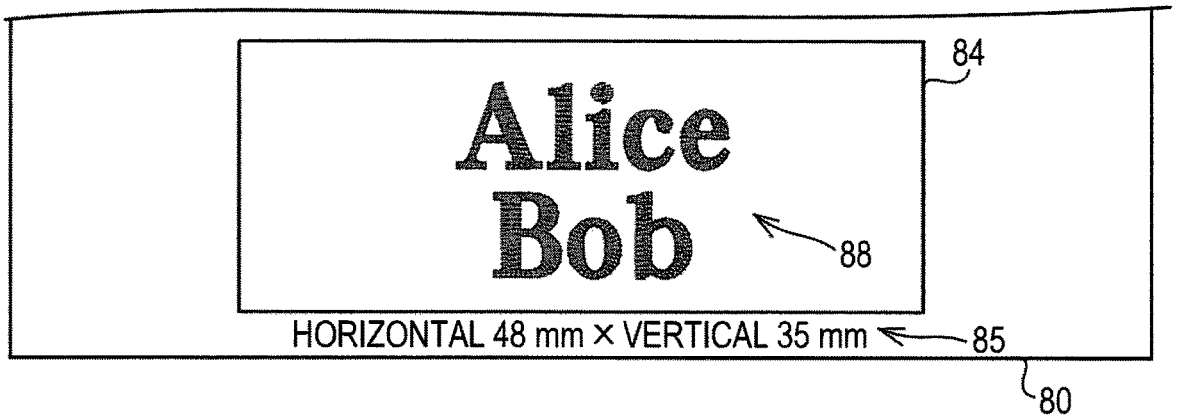

FIG. 5 is an explanatory diagram of a preview image 88 displayed in a field 84 of the input screen 80.

Figure 6:
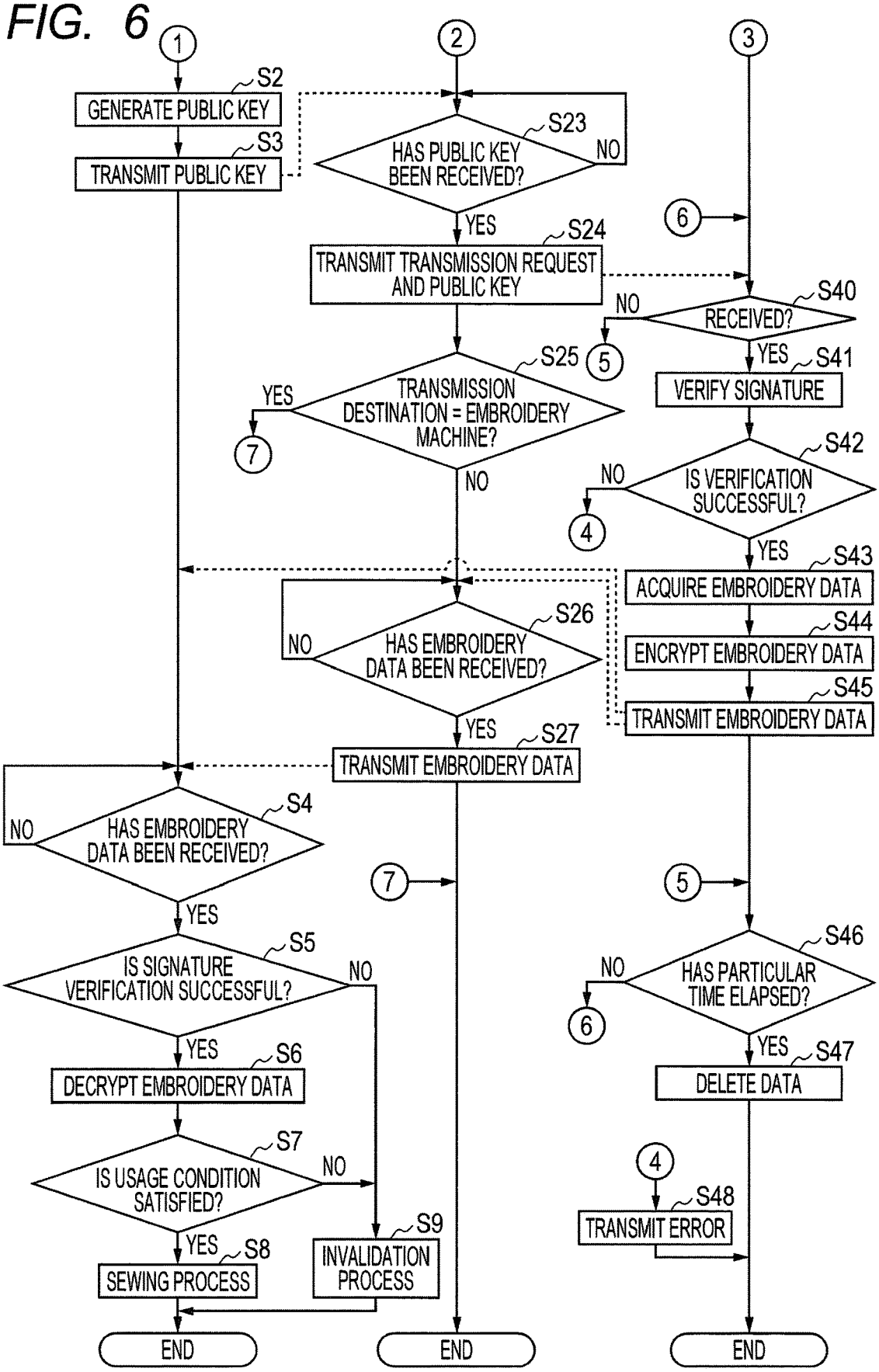

FIG. 6 is another part of a flowchart of the machine process, the terminal process, and the apparatus process executed by the embroidery data generation system 4.

Figure 7:
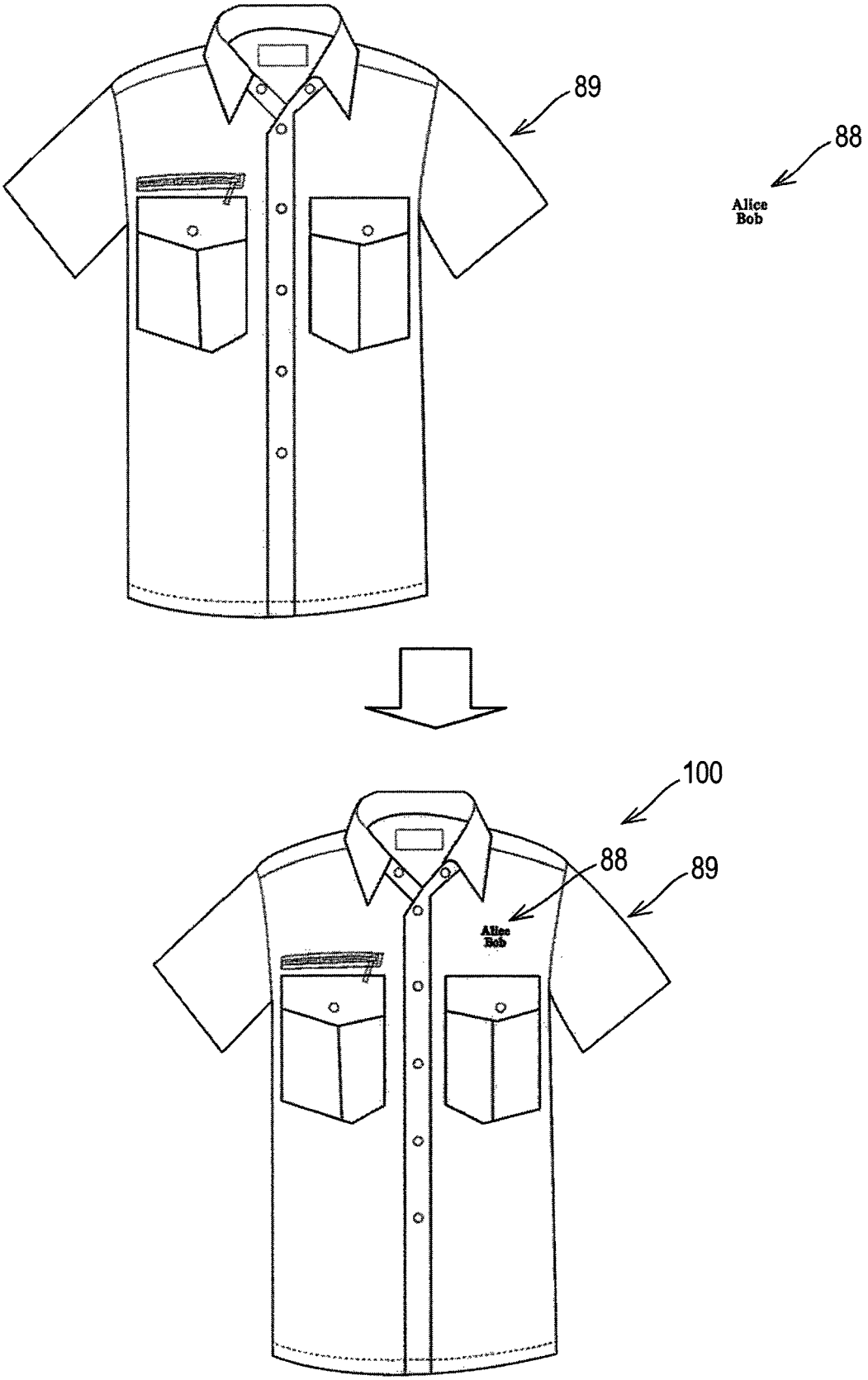

FIG. 7 is an explanatory diagram of a second image 100 displayed on the display 28 by the terminal apparatus 2.

Figure 8:
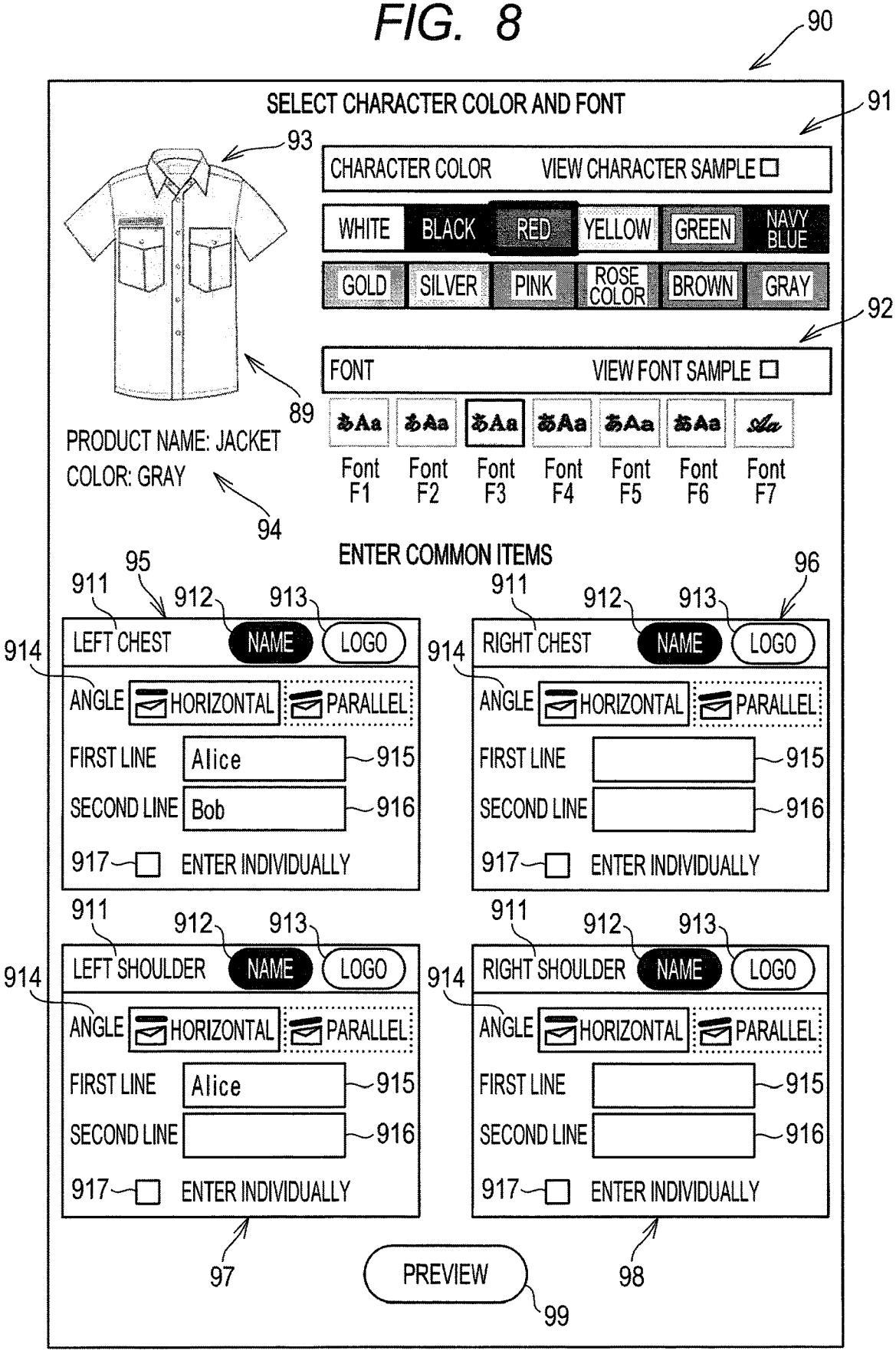

FIG. 8 is an explanatory diagram of an input screen 90 displayed on the display 28 of the terminal apparatus 2.

Figure 9:
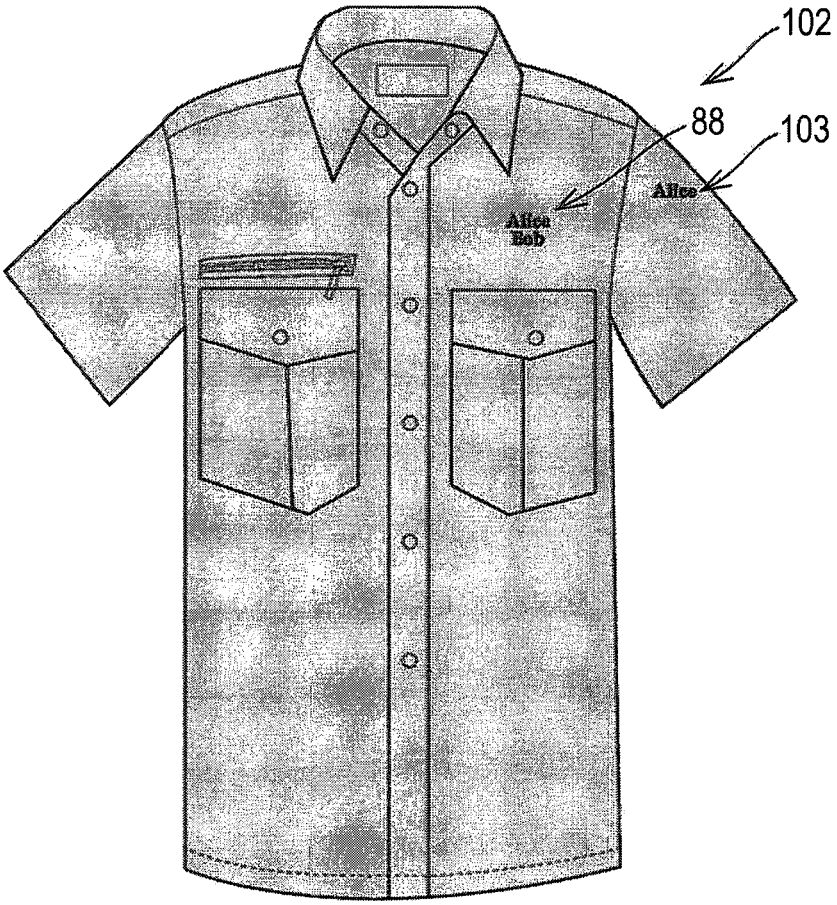

FIG. 9 is an explanatory diagram of a second image 102 displayed on the display 28 by the terminal apparatus 2.

An embodiment of this disclosure will be described with reference to the drawings. As shown in FIG. 1, an embroidery data generation system 4 (hereinafter referred to as "system 4") includes an embroidery data generation apparatus 1 (hereinafter referred to as "generation apparatus 1"), a terminal apparatus 2, and an embroidery sewing machine 3 (hereinafter referred to as "sewing machine 3" or "embroidery machine"). The generation apparatus 1 is a well-known personal computer (PC). The terminal apparatus 2 is a well-known tablet-type terminal apparatus. The sewing machine 3 is a known multi-needle sewing machine capable of embroidery sewing. The system 4 is configured such that, based on generation conditions acquired by the terminal apparatus 2, the generation apparatus 1 generates embroidery data and a preview image and the terminal apparatus 2 displays the preview image.

The generation apparatus 1 includes a CPU 11, a ROM 12, a RAM 13, a memory 14, and a communication interface 15. The CPU 11 performs control of the generation apparatus 1. The CPU 11 is electrically connected to the ROM 12, the RAM 13, the memory 14, and the communication interface 15 via a bus 16. The ROM 12 stores a boot program, BIOS, and so on. The RAM 13 stores temporary data. The memory 14 is a non-volatile memory such as an HDD and an SSD. The memory 14 stores various setting values necessary for executing a generation process described later. The communication interface 15 is an interface for connecting the generation apparatus 1 to a network 5. The CPU 11 performs transmission and reception of data with other apparatuses (for example, the terminal apparatus 2 and the sewing machine 3) connected to the network 5 via the communication interface 15.

The terminal apparatus 2 includes a CPU 21, a ROM 22, a RAM 23, a memory 24, a communication interface 25, and an input-output interface 27. The CPU 21 performs control of the terminal apparatus 2. The CPU 21 is electrically connected to the ROM 22, the RAM 23, the memory 24, the communication interface 25, and the input-output interface 27 via a bus 26. The ROM 22 stores a boot program, BIOS, and so on. The RAM 23 stores temporary data. The memory 24 is a non-volatile memory. The memory 24 stores various setting values necessary for executing a terminal process described later. The communication interface 25 is an interface for connecting the terminal apparatus 2 to the network 5. The CPU 21 performs transmission and reception of data with other apparatuses (for example, the generation apparatus 1 and the sewing machine 3) connected to the network 5 via the communication interface 25. The input-output interface 27 is connected to a display 28 and an input device 29. The display 28 is, for example, a liquid crystal display. The input device 29 is, for example, a touch panel and is used for inputting various instructions.

The sewing machine 3 includes a main-body portion 31, a needle-bar case 32, a spindle motor 76, a needle-bar case motor 77, a plurality of needle bars 33, a needle-bar drive mechanism 35, a cylinder bed 36, a throat plate 37, a movement mechanism 38, an operation interface 45, a pair of left and right thread-spool bases 49, and a thread path 52. The main-body portion 31 supports the needle-bar case 32 movably in a left-right direction. The spindle motor 76 and the needle-bar case motor 77 are accommodated inside the main-body portion 31. The needle-bar case motor 77 is configured to move the needle-bar case 32 in the left-right direction. A plurality of needle bars 33 and the needle-bar drive mechanism 35 are provided inside the needle-bar case 32. The sewing machine 3 in this example includes ten needle bars 33. Each of the ten needle bars 33 extends in a vertical direction and is disposed at an equal interval in the left-right direction. A sewing needle 34 is attached to a lower end of the needle bar 33. The needle-bar drive mechanism 35 is constituted to slide the drive needle-bar 33 in the plurality of needle bars 33, which will be described later, in the vertical direction in accordance with rotation of the spindle motor 76. The cylinder bed 36 extends cylindrically in the front-rear direction below the needle-bar case 32. At a distal end part of the cylinder bed 36, a hook and a hook drive mechanism (not shown) are provided. The hook drive mechanism drives the hook to rotate. The throat plate 37 is a plate with a rectangular shape on a plan view, provided on an upper surface of the cylinder bed 36. A needle hole penetrating in the vertical direction is formed in the throat plate 37. Among the plurality of needle bars 33, the needle bar 33 disposed at a drive position immediately above the needle hole formed in the throat plate 37 is the drive needle bar 33.

The movement mechanism 38 is provided below the needle-bar case 32. The movement mechanism 38 includes a holder 39, an X-motor 41, and a Y-motor 42. The holder 39 detachably supports one of a plurality of types of embroidery frames including an embroidery frame 44. The embroidery frame 44 detachably holds an object to be sewn (a sewn object). The sewn object is a worked cloth, for example. The movement mechanism 38 moves the embroidery frame 44 attached to the holder 39 to a position indicated by a specific XY coordinate system (embroidery coordinate system) by using the X-motor 41 and the Y-motor 42 as driving sources. An X-direction and a Y-direction of the embroidery coordinate system correspond to the left-right direction and the front-rear direction of the sewing machine 3, respectively.

The operation interface 45 is provided on the right of the main-body portion 31. The operation interface 45 includes a liquid crystal display (LCD) 46, a touch panel 47, and a start-stop switch 48. The touch panel 47 is provided on a surface of the LCD 46. The start-stop switch 48 is used when start or stop of sewing is instructed.

The pair of left and right thread-spool bases 49 are provided on a rear surface side of the upper surface of the main-body portion 31. On each of the thread-spool bases 49, a plurality of spool pins 50 are provided. The spool pin 50 supports a thread spool 51. A needle thread 56 is supplied from the thread spool 51 installed on the thread-spool base 49. The needle thread 56 is supplied to an eye hole of the sewing needle 34 attached to the lower end of the needle bar 33 via the thread path 52. The thread path 52 includes a thread guide 53, a thread tensioner 54, and a thread take-up 55.

A controller 60 of the sewing machine 3 includes a CPU 61, a ROM 62, a RAM 63, a memory 64, an input-output interface 66, and a communication interface 67. The CPU 61 is connected to the ROM 62, the RAM 63, the memory 64, the input-output interface 66, and the communication interface 67 via a bus 65. Drive circuits 71 to 75, the touch panel 47, and the start-stop switch 48 are connected to the input-output interface 66. The memory 64 is a non-volatile storage device. The memory 64 stores various set values required for execution of a machine process which will be described later.

The spindle motor 76 is connected to the drive circuit 71. The drive circuit 71 drives the spindle motor 76 in accordance with a control signal from the CPU 61. With the driving of the spindle motor 76, the needle-bar drive mechanism 35 is driven through a spindle (not shown) of the sewing machine 3, and the drive needle-bar 33 is vertically moved. The needle-bar case motor 77 is connected to the drive circuit 72. The drive circuit 72 drives the needle-bar case motor 77 in accordance with the control signal from the CPU 61 and moves the needle-bar case 32 in the left-right direction with respect to the main-body portion 31. The X-motor 41 is connected to the drive circuit 73. The Y-motor 42 is connected to the drive circuit 74. The drive circuits 73 and 74 drive the X-motor 41 and the Y-motor 42, respectively, in accordance with the control signal from the CPU 61. With the driving of the X-motor 41 and the Y-motor 42, the embroidery frame 44 attached to the movement mechanism 38 is moved in the left-right direction (X-direction) and the front-rear direction (Y-direction) by a movement amount according to the control signal. The drive circuit 75 displays an image on the LCD 46 in accordance with the control signal from the CPU 61. The communication interface 67 connects the sewing machine 3 to the network 5. The CPU 61 executes transmission and reception of data with other apparatuses (the generation apparatus 1 and the terminal apparatus 2, for example) connected to the network 5 via the communication interface 67.

An operation of the sewing machine 3 will be described in brief. Due to movement of the needle-bar case 32 in the left-right direction, one of the ten needle bars 33 is selected as the drive needle bar 33. In the sewing machine 3, the needle-bar drive mechanism 35 and the hook mechanism are driven with movement of the embroidery frame 44 in the X-direction and the Y-direction by the movement mechanism 38. As a result, an embroidery pattern is sewn to the sewn object held at the embroidery frame 44 by the sewing needle 34 attached to the drive needle bar 33.

By referring to FIGS. 2 to 6, processes of generating embroidery data by the CPU 11 of the generation apparatus 1 of the system 4, the CPU 21 of the terminal apparatus 2, and the CPU 61 of the sewing machine 3 in cooperation will be described in order of a terminal process, an apparatus process, and a machine process. The terminal process is processing executed by the CPU 21 of the terminal apparatus 2. The apparatus process is processing executed by the CPU 11 of the generation apparatus 1. The machine process is processing executed by the CPU 61 of the sewing machine 3. The embroidery data includes coordinate data and thread-color data. The coordinate data is data indicating a forming position of stitch included in the embroidery pattern, that is, a position of a needle point (needle drop point) by a coordinate of the embroidery coordinate system. That is, the coordinate data includes a data group expressing a plurality of coordinates for each of the needle points. The thread color data indicates colors of threads for sewing an embroidery pattern. Hereinafter, a step is abbreviated as S. As an example, a case will be described in which embroidery data is generated for sewing an embroidery pattern expressing characters (letters) in lateral two lines sewn on a chest part of a clothing item, such as work clothes.

The terminal process executed by the terminal apparatus 2 will be described. The CPU 21 of the terminal apparatus 2 reads out a terminal program stored in the storage portion 24 to the RAM 23 when an instruction to start the terminal process is obtained from the user after the power is turned ON. The CPU 21 executes the terminal process having the following steps in accordance with the instructions contained in the terminal program read out to the RAM 23. Various data obtained in a process of the terminal process are stored in the RAM 23 as appropriate.

As shown in FIG. 2, in the terminal process, the CPU 21 transmits a front-end request to the generation apparatus 1 (S11). The front end of the system 4 refers to a portion directly interacting with the user. The front end of the system 4 in this example is executed in the terminal apparatus 2. The CPU 21 determines whether a front-end delivery transmitted from the generation apparatus 1 has been received in response to the front-end request (S12). The CPU 21 waits for the reception of the front-end delivery (S12: NO). The front-end delivery includes data for executing the front end in the terminal apparatus 2. When the front-end delivery is received (S12: YES), the CPU 21 displays an input screen 80 shown in FIG. 3 on the display 28 (S13) based on the received front-end delivery. The input screen 80 is displayed by a Web browser, for example. In this case, the front-end delivery may be data for displaying the input screen 80 on the Web browser.

As shown in FIG. 3, the input screen 80 has fields 81 to 85 and keys 86 and 87. The field 81 displays conditions related to a font. The field 81 includes fields 811 and 812. The field 811 is a field displaying font type candidates. The font type candidates in this example are eight font types from fonts F1 to F8 stored, in the generation apparatus 1, as the fonts selected in advance by the user among 40 font types to be displayed on the input screen 80. In the field 811, a selected candidate among the eight font type candidates is displayed by being surrounded by a rectangle 813. The field 812 is a field for displaying font size candidates. The font size candidates in this example are the four sizes S, M, L, and LL. The method of indicating the font size may be changed as appropriate and may be indicated by numerals, for example. In the field 812, a selected candidate among the four font size candidates is displayed by being surrounded by a rectangle 814. The field 82 is a field displaying thread color candidates. The thread color candidates in this example are ten colors of black, white, red, pink, yellow, orange, green, blue, light blue, and purple which are selected in advance by the user among 24 thread colors and which are stored in the generation apparatus 1 as the thread colors to be displayed on the input screen 80. The number of thread color candidates in this example is the same as the number of the needle bars 33 of the sewing machine 3. The thread color candidates may be the same as the thread colors set for the sewing machine 3 or may be different from each other. In the field 82, the selected candidate among the ten thread-color candidates is displayed by being surrounded by a circle 821. The field 83 includes fields 831 and 832 for inputting character strings for embroidery. The field 831 is a field where a character string on a first line in horizontal writing is inputted, and the field 832 is a field where a character string on a second line in the horizontal writing is inputted. The number of characters which can be inputted may be set in the fields 831 and 832. The key 86 is a key for inputting an instruction for displaying a preview image showing the finished embroidery pattern under the generation condition inputted in each field on the display 28. The key 87 is a key for inputting an instruction for transmitting the embroidery data for sewing the embroidery pattern shown by the preview image to the sewing machine 3. The field 84 is a field for displaying the preview image. The field 85 is a field for displaying the size of the embroidery pattern shown by the preview image. The size of the embroidery pattern is indicated by a length in the X-direction (horizontal) and a length in the Y-direction (vertical) in the embroidery coordinate system of a minimum rectangle enclosing the embroidery pattern. The user inputs the generation condition of the embroidery data by operating the input device 29. The generation condition in this example includes the font type, the font size, the thread color, and the character string.

The CPU 21 determines whether an input of any one of the fields 811, 812, 82, 831, and 832 has been detected based on a detection result of the input device 29 (S14). If the input of the generation condition is detected (S14: YES), the CPU 21 acquires the generation condition of the embroidery data inputted via the input device 29 (S15). In a case where the generation condition is inputted as in the input screen 80 shown in FIG. 3, the CPU 21 acquires the font F1 as the font type, acquires M as the font size, acquires blue as the thread color, acquires the characters "Alice" as the character string on the first line, and acquires the characters "Bob" as the character string on the second line, respectively.

If the input of the generation condition is not detected (S14: NO) or subsequent to S15, the CPU 21 determines whether a key press on the key 86 has been detected based on the detection result of the input device 29 (S16). If a key press on the key 86 is not detected (S16: NO), the CPU 21 returns the processing to S14. If a key press on the key 86 is detected (S16: YES), the generation condition of the embroidery pattern acquired in S15 is transmitted to the generation apparatus 1 via the communication interface 25 (S17). As shown in the data 78 in FIG. 4, the CPU 21 in this example transmits an authentication token 781 and a generation condition 782 to the generation apparatus 1 in S17. The authentication token 781 is authentication information for authenticating the terminal apparatus 2 and is encrypted alphanumerical character strings, for example. The CPU 21 in this example transmits the authentication token 781 to the generation apparatus 1 before executing the processing of S19. The CPU 21 determines whether image data and an ID have been received, the image data and the ID being generated in the generation apparatus 1 in response to the transmission of the authentication token 781 and the generation condition 782 (S18). The CPU 21 waits until the image data and the ID have been received (S18: NO). Though not shown, if the image data and the ID are not received (S18: NO) and an error transmitted from the generation apparatus 1 is received, the CPU 21 displays an error message on the display 28 and then ends the terminal process.

When the image data and the ID are received (S18: YES), the CPU 21 displays a preview image 88 showing embroidery finish of the embroidery pattern on the display 28 as shown in FIG. 5 based on the image data transmitted from the generation apparatus 1 (S19). In S19 in the system 4 in this example, in addition to the image data and the ID, size information indicating the size of the embroidery pattern is also received. As shown in FIG. 5, the CPU 21 displays the preview image in the field 84 of the input screen 80 based on the image data and displays the size of the embroidery pattern in the field 85 based on the size information. In the field 85, the size in the X-direction is noted as "horizontal", while the size in the Y-direction is noted as "vertical". The user checks the preview image and the size of the embroidery pattern based on the fields 84 and 85, and when the user wishes to change the generation condition, the user changes a desired condition in the fields 811, 812, 82, 831, and 832. The CPU 21 detects an input of any one of the fields 811, 812, 82, 831, and 832 based on the detection result of the input device 29 as an input of a change instruction. The CPU21 determines whether the change instruction has been detected (S20). If the change instruction has been detected (S20: YES), the CPU 21 returns the processing to S15 and acquires the changed generation condition (S15).

When the change instruction is not detected (S20: NO), the CPU 21 determines whether the key 87 has been pressed based on the detection result of the input device 29 (S21). If a key press on the key 87 is not detected (S21: NO), the CPU 21 returns the processing to S20. If a key press on the key 87 is detected (S21: YES), the CPU 21 transmits, to the sewing machine 3, a public key request which requests generation and transmission of a public key for encrypting embroidery data (S22). As an algorithm for generating the public key, a publicly known algorithm may be employed as appropriate. As the algorithm for generating the public key, an optional method may be employed from RSA, DES (Data Encryption Standard), and ECC (Elliptic Curve Cryptograph), for example. The sewing machine 3 in this example generates the public key by using a 256-bit elliptic curve cryptograph (NIST P-256) stipulated by NIST.

As shown in FIG. 6, the CPU 21 determines whether the public key transmitted from the sewing machine 3 in response to the public key request has been received (S23). In S23 in the system 4 in this example, a signed public key of the sewing machine 3 is received. If the public key has not been received (S23: NO), the CPU 21 waits until the public key is received. When the public key is received (S23: YES), the CPU 21 transmits a transmission request together with the public key received in S23 to the generation apparatus 1 (S24). The transmission request is a request for transmission, to the terminal apparatus 2, of the embroidery data for sewing the embroidery pattern shown by the preview image which is being displayed in the field 84. The transmission request includes the authentication token 781 transmitted in S17, an ID 791 received in S18, and information of the apparatus which is a transmission destination of the encrypted embroidery data. The apparatus of the transmission destination in this example is the terminal apparatus 2 or the sewing machine 3. The CPU 21 in this example executes a request transmission process of transmitting the transmission request of the embroidery data to the generation apparatus 1 after executing a display control process in S19. The CPU 21 determines whether the apparatus of the transmission destination included in the transmission request is the sewing machine 3 (S25). If the transmission destination is the sewing machine 3 (S25: YES), the CPU ends the terminal process here.

If the transmission destination is not the sewing machine 3 (S25: NO), the CPU 21 determines whether embroidery data transmitted from the generation apparatus 1 in response to the transmission request has been received (S26). In S26 of the system 4 in this example, the CPU 21 receives the public key of the generation apparatus 1 and falsification detection information, in addition to the encrypted embroidery data. If the embroidery data has not been received (S26: NO), the CPU 21 waits until the embroidery data is received. When the embroidery data is received (S26: YES), the CPU 21 transmits the embroidery data received in S26 to the sewing machine 3 (S27). The CPU 21 in this example transmits, in addition to the encrypted embroidery data, the public key of the generation apparatus 1 and the falsification detection information to the sewing machine 3. The CPU 21 ends the terminal process here. Though not shown, if the embroidery data has not been received (S26: NO) and an error transmitted from the generation apparatus 1 is received, the CPU 21 displays an error message on the display 28 and then ends the terminal process.

Next, a generation process executed by the CPU 11 of the generation apparatus 1 will be described. The CPU 11 of the generation apparatus 1 reads out an apparatus program stored in the memory 14 to the RAM 13 when the power is turned ON. The CPU 11 executes the apparatus process having the following steps in accordance with instructions included in the apparatus program read out to the RAM 13. Various data obtained in the apparatus process are stored in the RAM 13 as appropriate.

As shown in FIG. 2, in the apparatus process, the CPU 11 determines whether a front-end request transmitted by the terminal apparatus 2 has been received (S31). If the front-end request has not been received (S31: NO), the CPU 11 waits until the front-end request is received. When the front-end request is received (S31: YES), the CPU 11 transmits, to the terminal apparatus 2, a front-end delivery corresponding to the terminal apparatus 2 (S32). The information included in the front-end delivery is associated with the ID of the terminal apparatus 2 and is stored in the memory 14. The CPU 11 acquires the information corresponding to the terminal apparatus 2 by referring to the memory 14 and transmits the front-end delivery to the terminal apparatus 2.

The CPU 11 determines whether the data 78 including the authentication token 781 and the generation condition 782 transmitted from the terminal apparatus 2 has been received via the communication interface 15 (S33). If the data 78 has not been received (S33: NO), the CPU 11 waits until the data 78 is received. When the data 78 is received (S33: YES), the CPU 11 performs usage authentication of the terminal apparatus 2 by using the authentication token 781 transmitted from the terminal apparatus 2 (S34). As an authentication method, a publicly-known method may be employed as appropriate in accordance with a type of the authentication token 781. The CPU 11 determines whether the authentication of the terminal apparatus 2 is successful in S34 (S35). If the authentication is not successful (S35: NO), as shown in FIG. 6, the CPU 11 transmits information indicating an authentication error to the terminal apparatus 2 (S48) and then ends the apparatus process.

When the authentication is successful (S35: YES), the CPU 11 generates embroidery data for sewing the embroidery pattern based on the generation condition received in S33 (S36). As a method of generating the embroidery data based on the generation condition, a publicly-known method may be set as appropriate. The CPU 11 identifies the shape and the size of the embroidery pattern based on the font type, the font size, the character strings on the first line and the second line included in the generation condition and generates coordinate data included in the embroidery data. The CPU 11 generates thread color data included in the embroidery data based on the thread color included in the generation condition. The CPU 11 generates image data for displaying a preview image on the display 28 of the terminal apparatus 2 based on the generation condition received in S33 (S37). The CPU 11 in this example generates the image data based on the embroidery data generated in S36. For example, the CPU 11 generates the image data by connecting points indicated by the coordinate data by line segments indicated by the thread colors in the sewing sequence. The background of the image data may be set as appropriate. For example, the image data may be image data through which the background of the image data is transparent or may be image data which is an image in which the background shows a particular color, pattern or the sewn object. As described above, the CPU 11 in this example executes an embroidery data generation process (S36) and an image data generation process (S37) when the usage authentication is successful in the authentication process in S34 (S35: YES).

The CPU 11 transmits, to the terminal apparatus 2, the data for displaying the preview image on the display 28 based on the image data generated in S37, the ID assigned to the image data, and the size information of the embroidery pattern (S38). The data for displaying the preview image on the display 28 may be the image data itself or a URL of the image data, for example. The ID may be information for identifying the image data and is expressed by alphanumeric characters, for example. When the usage authentication is successful in S34, the CPU 11 stores, in the memory 14, the generation condition 782 of the embroidery pattern received in the condition reception process in S33 in association with the authentication token 781 (S39). As shown in the data 79 in FIG. 4, the CPU 11 in this example stores, in the memory 14, the authentication token 781 received in S33, the generation condition 782, the embroidery data 792 generated in S36, the ID 791, and time information 793 in association with one another (S39). The time information 793 indicates the time when the processing of S39 is executed.

As shown in FIG. 6, the CPU 11 determines whether the transmission request transmitted from the terminal apparatus 2 and the public key generated by the sewing machine 3 by using a secret key have been received (S40). If the transmission request and the public key have not been received (40: NO), the CPU 11 executes processing of S46, which will be described later. If the transmission request and the public key have been received (S40: YES), the CPU 11 verifies the signature of the sewing machine 3 by using the public key of the sewing machine 3 (S41). S41 is processing for detecting impersonation. As a method of verifying the signature, a publicly-known method may be employed as appropriate in accordance with a type of the signature. The CPU 11 may also verify in S41 whether the ID 791 and the authentication token 781 included in the data 79 stored in the memory 14 in S39 match the ID and the authentication token included in the transmission request, respectively. The CPU 11 determines whether the verification of the signature of the sewing machine 3 is successful in S41 (S42). If the verification fails (S42: NO), an error is transmitted to the terminal apparatus 2 (S48) and then the apparatus process is ended here. If the verification is successful (S42: YES), the CPU 11 refers to the memory 14 and acquires the embroidery data 792 corresponding to the ID 791 and the authentication token 781 included in the transmission request (S43). The CPU 11 encrypts the embroidery data 792 generated in S36 and acquired in S43 by using the public key received in S40 (S44). The CPU 11 in this example generates a common key by ECDH and an IV (initialization vector) by using the secret key of the generation apparatus 1 and the public key of the sewing machine 3. The CPU 11 uses the generated common key and the IV to encrypt the embroidery data by using AES (Advanced Encryption Standard)-128. The CPU 11 in this example further generates falsification detection information for detecting falsification of the encrypted embroidery data and JSON parameter. As the falsification detection information, publicly-known information may be employed as appropriate and may be a GCM authentication tag, for example.

The CPU 11 transmits the generated embroidery data to the apparatus specified by the terminal apparatus 2 which transmitted the generation condition (S45). In response to reception of the transmission request transmitted from the terminal apparatus 2, the CPU 11 in this example transmits the embroidery data encrypted in S44, the public key of the generation apparatus 1, and the falsification detection information to the apparatus specified by the terminal apparatus 2 which transmitted the generation condition. The apparatus specified by the terminal apparatus 2 is the terminal apparatus 2 or the sewing machine 3. The CPU 11 determines whether a particular time has elapsed from the time indicated by the time information 793 stored in S39 (S46). The particular time may be set in advance and may be 24 hours, for example. If the particular time has not elapsed (S46: NO), the CPU 11 returns the processing to S40. If the particular time has elapsed (S46: YES), the CPU 11 deletes the data stored in S39 from the memory 14 (S47). In the generation apparatus 1, the processing in S47 prevents the data 79 from being continuously stored in the memory 14, which suppresses tightness of the data capacity of the memory 14. The CPU 11 ends the apparatus process here.

Next, the machine process executed by the CPU 61 of the sewing machine 3 will be described. When the CPU 61 of the sewing machine 3 acquires an instruction to start the machine process from the user after the power was turned ON, the CPU 61 reads out the sewing machine program stored in the memory 64 to the RAM 63. The CPU 61 executes the machine process having the following steps in accordance with the instruction included in the sewing machine program read out to the RAM 63. Various data acquired in the processing of the machine process are stored in the RAM 63 as appropriate.

As shown in FIG. 2, the CPU 61 of the sewing machine 3 determines whether the public key request transmitted from the terminal apparatus 2 has been received (S1). If the public key request has not been received (S1: NO), the CPU 61 waits until the public key request is acquired. If the public key request has been received (S1: YES), as shown in FIG. 6, the CPU 61 generates a secret key and generates a public key by using the generated secret key (S2). The CPU 61 in this example further generates a signature to the generated public key by using a signature key of the sewing machine 3. The signature may be generated by any method and the signature may be generated by ECDSA (Elliptic Curve Digital Signature Algorithm). The signature may indicate the manufacturer of the sewing machine 3, the model number of the sewing machine 3, and so on. The CPU 61 transmits the public key with the signature generated in S2 to the terminal apparatus 2 (S3). The CPU 61 stores the secret key and the signature in the memory 64.

The CPU 61 determines whether the encrypted embroidery data has been received, the encrypted embroidery data being generated by the generation apparatus 1 and transmitted from the generation apparatus 1 or the terminal apparatus 2 (S4). If the encrypted embroidery data has not been received (S4: NO), the CPU 61 waits until the encrypted embroidery data is received. If the encrypted embroidery data is received (S4: YES), the CPU 61 verifies the signature of the public key received in S4 by using the public key received in S4 and determines whether the verification of the signature is successful (S5). If the verification of the signature is not successful (S5: NO), the encrypted embroidery data is invalidated (S9), an error message is displayed on the LCD 46 and then the machine process is ended. The process of invalidating the embroidery data is a process of deleting the encrypted embroidery data, for example. The process of invalidating the embroidery data may be a process of ending the machine process after displaying the error message without performing sewing based on the embroidery data. If the verification of the signature is successful (S5: YES), the CPU 61 executes a decrypting process of decrypting the acquired encrypted embroidery data by using the secret key (S6). The CPU 61 in this example generates a common key by ECDH and IV by using the public key of the generation apparatus 1 and the secret key of the sewing machine 3. The CPU 61 decrypts the encrypted embroidery data by AES128GCM by using the generated common key and the IV. The CPU 61 nullifies the secret key and the signature of the sewing machine 3 stored in the memory 64 after generating the common key.

The CPU 61 determines whether the decrypted embroidery data satisfies the particular usage condition (S7). The usage condition may be set as appropriate. The usage condition may be a condition that a verification result using the GCM authentication tag is successful, for example. If the verification result using the GCM authentication tag is successful, it indicates that the JSON parameter associated with the embroidery data has not been falsified. Thus, the CPU 61 in this example determines that the embroidery data has not been falsified if the verification result using the GCM authentication tag is successful. If the embroidery data does not satisfy the particular usage condition (S7: NO), the CPU 61 executes an invalidation process of invalidating the embroidery data (S9) and ends the machine process after displaying an error message on the LCD 46. The invalidation process is a process of deleting the decrypted embroidery data, for example. If the usage condition is satisfied (S7: YES), the CPU 61 executes a sewing process of sewing the embroidery pattern based on the decrypted embroidery data (S8). The CPU 61 selects one needle bar 33 corresponding to the thread spool 51 of the thread color indicated by the thread color data as the drive needle bar 33 among the ten needle bars 33 by movement of the needle-bar case 32 in the left-right direction. The CPU 61 drives the movement mechanism 38, the needle-bar drive mechanism 35, and the hook mechanism in accordance with the coordinate data and sews the embroidery pattern to the sewn object held by the embroidery frame 44 with the sewing needle 34 attached to the drive needle bar 33. Subsequently to S8 or S9, the CPU 61 ends the machine process here.

In the above embodiment, the system 4, the generation apparatus 1, the terminal apparatus 2, the sewing machine 3, and the network 5 are examples of the embroidery data generation system, the embroidery data generation apparatus, the terminal apparatus, the sewing machine, and the network, respectively. The CPU 11, the memory 14, and the communication interface 15 are examples of the apparatus controller, the memory, and the apparatus communication interface, respectively. The CPU 21, the communication interface 25, the display 28, and the input device 29 are examples of the terminal controller, the terminal communication interface, the display, and the input device, respectively. The CPU 61 is an example of a sewing machine controller. The process of S15 is an example of the condition acquisition process. The process of S17 is an example of the condition transmission process. The process of S19 is an example of the display control process. The process of S33 is an example of the condition reception process. The process of S36 is an example of the embroidery data generation process. The process of S37 is an example of the image data generation process. The process of S38 is an example of the image data transmission process. The process of S45 is an example of the embroidery data transmission process. The process of S24 is an example of the request transmission process. The process of S39 is an example of the memory control process. The process of S17 is an example of the token transmission process. The process of S34 is an example of the authentication process. The process of S39 is an example of the memory control process. The process of S40 is an example of the key reception process. The process of S44 is an example of the encryption process. The process of S6 is an example of the decryption process. The process of S9 is an example of the invalidation process.

In the system 4 of the above embodiment, the terminal apparatus 2 and the generation apparatus 1 that generates embroidery data for sewing an embroidery pattern on the sewing machine 3 are connected to the network 5 so as to communicate with each other. The terminal apparatus 2 includes the communication interface 25, the input device 29, and the CPU 21. The communication interface 25 communicates with the generation apparatus 1. The input device 29 inputs information. The display 28 displays an image. The CPU 21 controls the communication interface 25 and the display 28. The CPU 21 executes the condition acquisition process (S15), the condition transmission process (S17), and the display control process (S19). In the processing of S15, the CPU 21 acquires the embroidery data generation condition inputted via the input device 29. In the processing of S17, the CPU 21 transmits the acquired embroidery pattern generation condition to the generation apparatus 1 via the communication interface 25. In the processing of S19, the CPU 21 displays a preview image showing the embroidery finish of the embroidery pattern on the display 28 based on the image data transmitted from the generation apparatus 1. The embroidery data generation apparatus 1 includes the communication interface 15 and the CPU 11. The communication interface 15 communicates with the terminal apparatus 2. The CPU 11 controls the communication interface 15. The CPU 11 executes the condition reception process (S33), the embroidery data generation process (S36), the image data generation process (S37), and the image data transmission process (S38). In the processing of S33, the CPU 11 receives the generation condition transmitted from the terminal apparatus 2 via the communication interface 15. In S36, the CPU 11 generates embroidery data for sewing the embroidery pattern based on the received generation condition. In the processing of S37, the CPU 11 generates image data for displaying the preview image on the display 28 of the terminal apparatus 2 based on the received generation condition. In the processing of S38, the CPU 11 transmits the generated image data to the terminal apparatus 2 that has transmitted the generation condition.

In the system 4, since the terminal apparatus 2 does not generate image data of the preview image of an embroidery pattern and does not generate embroidery data, the terminal apparatus 2 does not require an application for generating the image data and the embroidery data. Inputting the embroidery data generation condition and viewing the preview image are performed on the terminal apparatus 2, and the image data and the embroidery data are generated on the generation apparatus 1. Thus, the apparatuses for performing processes are separated, which simplifies processing performed by the application required on the terminal apparatus 2. The system 4 improves the convenience of the user when generating embroidery data for sewing an embroidery pattern on the sewing machine 3, compared with the conventional system. In the system 4, since the terminal apparatus 2 displays the input screen 80 based on the front-end delivery transmitted from the generation apparatus 1, no application for generating data for displaying the input screen 80 is required.

The CPU 11 of the generation apparatus 1 executes the embroidery data transmission process of transmitting the generated embroidery data to the apparatus specified by the terminal apparatus 2 that has transmitted the generation condition (S45). This enables the system 4 to transmit the embroidery data to the apparatus specified by the terminal apparatus 2.

After executing the display control process (S19), the CPU 21 of the terminal apparatus 2 executes the request transmission process of transmitting an embroidery data transmission request to the generation apparatus 1 (S24). In response to receiving the transmission request transmitted from the terminal apparatus 2, the CPU 11 of the generation apparatus 1 executes the embroidery data transmission process. Thus, in the system 4, the embroidery data is transmitted to the apparatus specified by the terminal apparatus 2 only when the transmission request is transmitted from the terminal apparatus 2. The system 4 avoids transmitting the embroidery data when it is not necessary to transmit the embroidery data to the apparatus specified by the terminal apparatus 2, such as when it is desired to modify the generation condition.

The generation apparatus 1 includes the memory 14. The CPU 21 executes the token transmission process of transmitting the authentication token 781 to the generation apparatus 1 before executing the display control process (S17). The CPU 11 executes the authentication process (S34) and the storage control process (S39). In the processing of S34, the CPU 11 uses the authentication token 781 transmitted from the terminal apparatus 2 to perform usage authentication of the terminal apparatus 2. In the processing of S39, when the usage authentication is successful in S34 (S35: YES), the CPU 11 stores, in the memory 14, the embroidery pattern generation condition 782 received in the condition reception process in association with the authentication token 781. When the usage authentication is successful in S34 (S35: YES), the CPU 11 executes the image data generation process (S37). In the embroidery data generation process, in response to determining that the usage authentication is successful in the authentication process and that the generation condition has been received, the CPU 11 generates embroidery data based on the generation condition stored in the memory 14. Thus, by executing the authentication process, the system 4 restricts an apparatus other than the terminal apparatus 2 that has transmitted the generation condition from illegally accessing the generation apparatus 1 and using the image data and the embroidery data generated based on the generation condition.

The system 4 includes the sewing machine 3. The CPU 11 of the generation apparatus 1 executes the key reception process (S40) and the encryption process (S44). In the processing of S40, the CPU 11 receives the public key generated by the sewing machine 3 using the private key. In the processing of S44, the CPU 11 encrypts, by using the received public key, the embroidery data generated in the embroidery data generation process. In the processing of S45, the CPU 11 transmits the encrypted embroidery data to the apparatus specified by the terminal apparatus 2 that has transmitted the generation condition. The sewing machine 3 includes the CPU 61. The CPU 61 acquires the encrypted embroidery data generated by the generation apparatus 1 (S4), and executes the decryption process of decrypting the acquired encrypted embroidery data by using the private key (S6). In the system 4, only the sewing machine 3 having generated the public key is able to decrypt the encrypted embroidery data, which prevents the embroidery data from being duplicated or stolen.

When the embroidery data does not satisfy a particular usage condition (S7: NO), the CPU 61 of the sewing machine 3 executes the invalidation process of invalidating the embroidery data (S9). The system 4 prevents the sewing machine 3 from sewing an embroidery pattern based on embroidery data that does not satisfy the usage condition.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

This disclosure may be implemented in various embodiments, for example, a computer-readable medium storing a terminal program, a computer-readable medium storing an apparatus program, an embroidery data generation method executed by the apparatus controller of the embroidery data generation apparatus, an embroidery data generation method executed by the terminal controller of the embroidery data terminal apparatus, and so on. The embroidery data generation apparatus 1 may be the sewing machine 3. In this case, the system 4 utilizes the application for generating embroidery data of the sewing machine 3, and the processes of encrypting the embroidery data and transmitting the embroidery data may be omitted.

(A) The configuration of the sewing machine 3 may be changed as appropriate. The sewing machine 3 may be an industrial sewing machine or a household embroidery machine as long as the sewing machine 3 is capable of sewing embroidery. In a case where the sewing machine 3 is a multi-needle sewing machine, the number of needle bars 33 may be appropriately changed. The configuration of the terminal apparatus 2 may be appropriately changed, and may be, for example, a PC, a smartphone, and so on. The display 28 of the terminal apparatus 2 may be any display as long as it can display an image, and may be, for example, an organic EL display, a plasma display, a plasma tube array display, an electronic paper display using electrophoresis and so on. The input device 29 of the terminal apparatus 2 may be a keyboard, a mouse, a joystick, and so on, in addition to/instead of the touch panel.

(B) The program including commands for executing the processes of FIGS. 2 and 6 may be stored in the storage device of each apparatus by the time when each of the CPUs 11, 21, and 61 of the system 4 executes the corresponding program. Thus, each of the acquisition method and acquisition route of the program and the device for storing the program may be appropriately changed. The program executed by each apparatus may be received from another apparatus via a cable or wireless communication and may be stored in a storage device such as a memory. Other apparatuses include, for example, a PC and a server connected via a network.

(C) Each step of the apparatus process is not limited to the example executed by the CPU 11, and a part or the entirety may be executed by another electronic device (for example, ASIC). Similarly, each step of the terminal process is not limited to the example executed by the CPU 21, and a part or the entirety may be executed by another electronic device. Each step of the machine process is not limited to the example executed by the CPU 61, and a part or the entirety may be executed by another electronic device. Each step of the apparatus process, the terminal process, and the machine process may be executed by a plurality of electronic devices (for example, a plurality of CPUs) in a distributed manner. In the apparatus process, the terminal process, and the machine process, the order of each step may be changed, steps may be omitted, and additions may be made as necessary. The following changes may be made to the apparatus process, the terminal process, and the machine process as appropriate.

As in a first modification shown in FIG. 7, a preview image displayed based on image data may be appropriately changed. As shown in FIG. 7, in the system 4 of the first modification, the CPU 21 of the terminal apparatus 2 displays a second image 100 on the display 28 in the display control process of S19. The second image 100 (composite image) is an image in which a preview image 88 is arranged in an embroidery area in a first image 89 (sewn-object image) indicating a sewn object on which an embroidery pattern is sewn by the sewing machine 3. The embroidery area is an area in which embroidery can be performed in the sewn object. The first image 89 indicates, for example, a jacket of work clothes. In a first method of the first modification, the CPU 11 generates image data indicating the second image 100 based on image data representing the first image 89, arrangement information indicating arrangement of the embroidery area in the first image 89, and the preview image 88 (S37). The image data representing the first image 89 and the arrangement information are stored in the memory 14. The CPU 11 transmits the generated image data to the terminal apparatus 2 (S38). The CPU 21 displays the second image 100 on the display 28 based on the image data transmitted from the generation apparatus 1 (S19). In a second method of the first modification, the CPU 11 generates image data representing the preview image 88 transparent to the background (S37), and transmits the generated image data to the terminal apparatus 2 (S38). The CPU 21 generates image data representing the second image 100 based on the image data transmitted from the generation apparatus 1 and the image data representing the first image 89 and the arrangement information stored in the memory 24, and displays the second image 100 on the display 28 based on the generated image data (S19). According to the system 4 of the first modification, it is possible for the user to confirm the arrangement of the embroidery pattern on the sewn object in addition to the embroidery finish image, based on the second image 100 displayed on the display 28.

As to the generation condition, the type, number, input method, and so on may be appropriately changed according to the type of the embroidery pattern. The embroidery pattern may be a graphic pattern, or may be a pattern representing a photograph, an illustration, and so on. In a case where the embroidery pattern is a character (letter) pattern, the generation condition may be an arbitrary number of conditions selected from the group of character string, thread color, typeface, character size, character spacing, line spacing, tilt, alignment condition, vertical/horizontal writing, and thread density. The alignment condition includes, for example, left alignment, right alignment, horizontal center alignment, top alignment, bottom alignment, and vertical center alignment. In this case, the left-right direction and the vertical direction correspond to the X direction and the Y direction of the embroidery coordinate system, respectively. In a case where the embroidery pattern is a graphic pattern, the generation condition may be, for example, an arbitrary number of conditions selected from the group of thread color, stitch type, and thread density. The stitch types include, for example, tatami-mat stitches and satin stitches.

As in a second modification shown in FIG. 8, the CPU 21 of the terminal apparatus 2 may display an input screen 90 on the display 28 in S13 and, in the condition acquisition process of S15, may acquire a generation condition for each of a plurality of embroidery areas that are set on the sewn object. As shown in FIG. 8, the input screen 90 has fields 91 to 98 and a key 99. The field 91 is a field for displaying thread color candidates. The field 92 is a field for displaying font type candidates. The field 93 is a field for displaying the first image 89 representing the sewn object. The field 94 is a field for displaying the product name and color of the sewn object. The fields 95 to 98 are fields for inputting the generation condition for each of the plurality of embroidery areas set in the sewn object that is displayed in the field 93. Each of the fields 95 to 98 includes fields 911 to 916 and a check box 917. The field 911 indicates the position of the embroidery area with respect to the sewn object. The field 911 in the field 95 indicates the left chest, the field 911 in the field 96 indicates the right chest, the field 911 in the field 97 indicates the left shoulder, and the field 911 in the field 98 indicates the right shoulder. The field 912 is a field for selecting "Name" embroidery in which a character pattern (such as a name) is embroidered. The field 913 is a field for selecting "Logo" embroidery in which a graphic pattern is embroidered. Regarding the fields 912 and 913, only one of them may be selectable, or both may be selectable. The field 914 is a field for selecting an angle with respect to the reference. The reference is, for example, the line at the upper end of the pocket or fastener of the sewn object. The reference is, for example, the line at the lower end of the sleeve. The reference may be different depending on the embroidery area. In the field 914, either horizontal or parallel to the reference is selected. The field 915 is a field for inputting a character string on the first line. The field 916 is a field for inputting a character string on the second line. The check box 917 is selected when switching from a setting mode in which the character string of the second line is a common character string for a plurality of sewn objects to another setting mode in which the character string of the second line is an individual character string for each of the plurality of sewn objects. When the check box 917 is selected, the field 916 is displayed for each of the plurality of sewn objects. The key 99 is a key instructing the display 28 to display the preview image.

The generation apparatus 1 of the second modification may store, for example, for each of the plurality of sewn objects, the information on the embroidery area, the image representing the sewn object, and the information on the sewn object in association with one another in the memory 14. The information on the embroidery area includes, for example, the arrangement in the sewn object, the size, the inclination with respect to the reference, and so on. In this case, in S32, the generation apparatus 1 may transmit a front-end delivery for displaying, on the input screen 90, information on the embroidery area of the sewn object specified by the terminal apparatus 2 among the plurality of sewn objects. The CPU 21 of the terminal apparatus 2 may display the input screen 90 based on the front-end delivery transmitted from the generation apparatus 1 (S13). The CPU 21 of the second modification transmits a plurality of generation conditions of the embroidery pattern acquired in S15 to the generation apparatus 1 via the communication interface 25 (S17). In the image data generation process of S37, the CPU 11 of the generation apparatus 1 generates image data for displaying the second image 102 on the display 28, based on each of the plurality of generation conditions received in S33 (S37). The second image 102 is an image in which the preview image 88, 103 is arranged in the embroidery area that is set for the sewn object, in the first image 89 represented by the image data stored in the memory 14. In the system 4 of the second modification, the generation condition is set for each of the plurality of embroidery areas, which improves the convenience of the user when generating embroidery data according to the plurality of generation conditions. In a case where the generation condition is set for each of the plurality of embroidery areas, or where the generation condition is set for a plurality of sewn objects, the plurality of generation conditions may be inputted to the terminal apparatus 2 in a CSV format.

In the system 4, a part or all of the process for encrypting the embroidery data and the process for improving security (S22 to S24, S1 to S3, S41, 42, S44, S5, S6) may be omitted or changed. For example, the terminal apparatus 2 may perform a process for acquiring a public key from the sewing machine 3 before transmitting the generation condition, and transmit the public key acquired from the sewing machine 3 to the generation apparatus 1 together with the generation condition (S17). In this case, the generation apparatus 1 may encrypt the generated embroidery data using the public key received from the terminal apparatus 2, without receiving the transmission request.

The usage condition of S7 may not be set or may be changed as appropriate. The usage condition may be the number of times an embroidery pattern is sewn based on embroidery data, or may be the period after the embroidery data is decrypted. The number of times may be set to any number of one or more. The usage condition may be set in the generation apparatus 1 according to the request from the terminal apparatus 2 and the embroidery data. The usage condition may be the same regardless of the request from the terminal apparatus 2 and the embroidery data. The usage condition may be set by the terminal apparatus 2 or the sewing machine 3. The invalidation process may be appropriately changed according to the usage condition. For example, in a case where the usage condition sets an upper limit of the number of uses, the sewing machine 3 may execute the sewing process based on the embroidery data, then increment the number of uses with the initial value set to 0, determine whether the number of uses exceeds the upper limit, and delete the embroidery data when the number of times of uses exceeds the upper limit, thereby performing the invalidation process. The usage condition may be changed according to condition data transmitted together with the embroidery data. The condition data is a flag, for example. When the flag is TRUE, the CPU 61 of the sewing machine 3 may delete the embroidery data after the sewing process, thereby invalidating the embroidery data. When the flag is FALSE, the CPU 61 may store the embroidery data in the memory 64 of the sewing machine 3 without deleting the embroidery data after the sewing process. In this case, when the flag is TRUE, the number of sewing operations based on the embroidery data is limited to one, and when the flag is FALSE, the number of sewing operations is unlimited.

The terminal apparatus 2 may omit the process of transmitting the transmission request to the generation apparatus 1. In this case, the generation apparatus 1 may transmit the generated embroidery data to the apparatus specified by the terminal apparatus 2 when transmitting the image data, without receiving the transmission request. The terminal apparatus 2 may omit the process of transmitting the authentication token 781. In this case, the generation apparatus 1 may omit the processes of S34 and S35.

What is claimed is:

1. An embroidery data generation system comprising:

a terminal apparatus;

an embroidery machine; and an embroidery data generation apparatus configured to generate embroidery data for sewing an embroidery pattern with the embroidery machine, the terminal apparatus and the embroidery data generation apparatus being connected to each other via a network so as to communicate with each other, the terminal apparatus including:

a terminal communication interface configured to communicate with the embroidery data generation apparatus;

an input device;

a display configured to display an image; and a terminal controller configured to control the terminal communication interface and the display, the terminal controller being configured to:

acquire a generation condition of the embroidery data via the input device;

transmit the acquired generation condition to the embroidery data generation apparatus via the terminal communication interface; and control the display to display a preview image indicating an embroidery finish of the embroidery pattern based on image data transmitted from the embroidery data generation apparatus, the embroidery data generation apparatus including:

an apparatus communication interface configured to communicate with the terminal apparatus; and an apparatus controller configured to control the apparatus communication interface, the apparatus controller being configured to:

receive the generation condition transmitted from the terminal apparatus via the apparatus communication interface;

generate the embroidery data for sewing the embroidery pattern based on the received generation condition;

generate the image data for displaying the preview image on the display of the terminal apparatus based on the received generation condition;

transmit the generated image data to the terminal apparatus having transmitted the generation condition;

receive a public key, the public key being generated by the embroidery machine by using a private key;

encrypt the generated embroidery data by using the received public key; and transmit the encrypted embroidery data to an apparatus specified by the terminal apparatus having transmitted the generation condition, the embroidery machine including a machine controller configured to:

acquire the encrypted embroidery data generated by the embroidery data generation apparatus; and decrypt the acquired encrypted embroidery data by using the private key.

2. The embroidery data generation system according to claim 1, wherein the terminal controller is further configured to, after displaying the preview image, transmit a transmission request for the embroidery data to the embroidery data generation apparatus; and wherein the apparatus controller is configured to, in response to receiving the transmission request transmitted from the terminal apparatus, transmit the generated embroidery data to the apparatus specified by the terminal apparatus having transmitted the generation condition.

3. The embroidery data generation system according to claim 2, wherein the embroidery data generation apparatus further comprises a memory;

wherein the terminal controller is further configured to, before displaying the preview image, transmit an authentication token to the embroidery data generation apparatus;

wherein the apparatus controller is configured to:

perform usage authentication of the terminal apparatus by using the authentication token transmitted from the terminal apparatus;

in response to determining that the usage authentication is successful, store, in the memory, the received generation condition in association with the authentication token;

in response to determining that the usage authentication is successful, generate the image data; and in response to determining that the usage authentication is successful and that the transmission request is received, generate the embroidery data based on the generation condition stored in the memory.

4. The embroidery data generation system according to claim 1, wherein the machine controller is configured to:

determine whether the embroidery data satisfies a particular usage condition; and in response to determining that the embroidery data does not satisfy the particular usage condition, invalidate the embroidery data.

5. The embroidery data generation system according to claim 1, wherein the terminal controller is configured to:

control the display to display a composite image in which the preview image is arranged in an embroidery area of a sewn-object image, the sewn-object image indicating a sewn object on which the embroidery pattern is sewn by the embroidery machine, the embroidery area being set to the sewn object.

6. The embroidery data generation system according to claim 5, wherein the terminal controller is configured to:

acquire the generation condition for each of a plurality of embroidery areas set to the sewn object; and transmit the acquired generation condition for each of the plurality of embroidery areas to the embroidery data generation apparatus via the terminal communication interface; and wherein the apparatus controller is configured to:

receive the generation condition for each of the plurality of embroidery areas from the terminal apparatus via the apparatus communication interface; and based on the received generation condition for each of the plurality of embroidery areas, generate the image data for displaying, on the display, the composite image in which the preview image is arranged in each of the plurality of embroidery areas.

7. A non-transitory computer-readable storage medium storing a set of program instructions for a terminal apparatus including an input device, a terminal communication interface, and a display, the set of program instructions, when executed by a controller of the terminal apparatus, causing the terminal apparatus to perform:

acquiring a generation condition of embroidery data for sewing an embroidery pattern with an embroidery machine, the generation condition being inputted via the input device;

transmitting the acquired generation condition to an embroidery data generation apparatus via the terminal communication interface;

controlling the display to display a preview image indicating an embroidery finish of the embroidery pattern based on image data transmitted from the embroidery data generation apparatus;

receiving a public key, the public key being generated by the embroidery machine by using a private key;

transmitting a transmission request for the embroidery data to the embroidery data generation apparatus, the transmission request including information specifying the terminal apparatus as an apparatus of a transmission destination of the embroidery data; transmitting the public key to the embroidery data generation apparatus;

receiving, from the embroidery data generation apparatus, the embroidery data encrypted by using the public key; and transmitting, to the embroidery machine, the embroidery data encrypted by using the public key.

8. The non-transitory computer-readable storage medium according to claim 7, wherein the set of program instructions, when executed by the controller, causes the terminal apparatus to perform:

before displaying the preview image, transmitting an authentication token to the embroidery data generation apparatus, the transmission request including the authentication token.

9. A non-transitory computer-readable storage medium storing a set of program instructions for an embroidery data generation apparatus including an apparatus communication interface, the set of program instructions, when executed by a controller of the embroidery data generation apparatus, causing the embroidery data generation apparatus to perform:

receiving a generation condition of embroidery data for sewing an embroidery pattern with an embroidery machine, the generation condition being received from a terminal apparatus via the apparatus communication interface;

based on the received generation condition, generating image data for displaying a preview image indicating an embroidery finish of the embroidery pattern on a display of the terminal apparatus;

transmitting the generated image data to the terminal apparatus having transmitted the generation condition;

generating the embroidery data for sewing the embroidery pattern based on the received generation condition;

receiving a public key, the public key being generated by the embroidery machine by using a private key; and encrypting the generated embroidery data by using the received public key.

10. The non-transitory computer-readable storage medium according to claim 9, wherein the set of program instructions, when executed by the controller, causes the embroidery data generation apparatus to perform:

transmitting the generated embroidery data to an apparatus specified by the terminal apparatus having transmitted the generation condition.

11. The non-transitory computer-readable storage medium according to claim 10, wherein the set of program instructions, when executed by the controller, causes the embroidery data generation apparatus to perform:

transmitting the embroidery data in response to receiving a transmission request transmitted from the terminal apparatus.

12. The non-transitory computer-readable storage medium according to claim 11, wherein the set of program instructions, when executed by the controller, causes the embroidery data generation apparatus to perform:

executing usage authentication of the terminal apparatus by using an authentication token transmitted from the terminal apparatus;

in response to determining that the usage authentication is successful, storing, in a memory of the embroidery data generation apparatus, the received generation condition in association with the authentication token;

in response to determining that the usage authentication is successful, generating the image data; and in response to determining that the usage authentication is successful and that the transmission request is received, generating the embroidery data based on the generation condition stored in the memory.

13. The non-transitory computer-readable storage medium according to claim 12, wherein the set of program instructions, when executed by the controller, causes the embroidery data generation apparatus to perform:

storing time information in the memory, the time information indicating time when the generation condition is stored in association with the authentication token; determining whether a particular time has elapsed from the time indicated by the time information stored in the memory; and in response to determining that the particular time has elapsed from the time indicated by the time information, deleting the generation condition, the authentication token, and the embroidery data from the memory.

14. A non-transitory computer-readable storage medium storing a set of program instructions for an embroidery data generation apparatus including an apparatus communication interface, the set of program instructions, when executed by a controller of the embroidery data generation apparatus, causing the embroidery data generation apparatus to perform:

receiving a generation condition of embroidery data for sewing an embroidery pattern with an embroidery machine, the generation condition being received from a terminal apparatus via the apparatus communication interface;

executing usage authentication of the terminal apparatus by using an authentication token transmitted from the terminal apparatus;

in response to determining that the usage authentication is successful, generating, based on the received generation condition, image data for displaying a preview image indicating an embroidery finish of the embroidery pattern on a display of the terminal apparatus;

transmitting the generated image data to the terminal apparatus having transmitted the generation condition;

generating the embroidery data for sewing the embroidery pattern based on the received generation condition;

in response to determining that the usage authentication is successful, storing, in a memory of the embroidery data generation apparatus, the received generation condition in association with the authentication token;

storing time information in the memory, the time information indicating time when the generation condition is stored in association with the authentication token;

in response to determining that the usage authentication is successful and that a transmission request is received from the terminal apparatus, transmitting the generated embroidery data to an apparatus specified by the terminal apparatus having transmitted the generation condition;

determining whether a particular time has elapsed from the time indicated by the time information stored in the memory; and in response to determining that the particular time has elapsed from the time indicated by the time information, deleting the generation condition, the authentication token, and the embroidery data from the memory.

* * * * *